US007082806B1

(12) United States Patent
Hurlbutt

(10) Patent No.: US 7,082,806 B1
(45) Date of Patent: Aug. 1, 2006

(54) METHOD OF MANUFACTURING A DIAPHRAGM BACKING PLATE

(75) Inventor: Ryan M Hurlbutt, Niles, MI (US)

(73) Assignee: Robert Bosch GmbH, Stuttgart (DE)

( * ) Notice: Subject to any disclaimer, the term of this patent is extended or adjusted under 35 U.S.C. 154(b) by 34 days.

(21) Appl. No.: 10/710,716

(22) Filed: Jul. 29, 2004

(51) Int. Cl.
*B21D 28/26* (2006.01)
*B21D 53/00* (2006.01)

(52) U.S. Cl. ..... 72/336

(58) Field of Classification Search ..... 72/336, 72/335, 334, 329, 330
See application file for complete search history.

(56) References Cited

U.S. PATENT DOCUMENTS 2,988,032 A * 6/1961 Voissem ..... 72/336
3,496,753 A * 2/1970 Gibbings ..... 72/339
5,007,329 A * 4/1991 Toepperwien ..... 92/98 D
5,123,271 A * 6/1992 Sofy et al. ..... 72/336
5,158,004 A * 10/1992 Bauer ..... 91/369.2

* cited by examiner

*Primary Examiner*—Daniel C. Crane
(74) *Attorney, Agent, or Firm*—Leo H. McCormick, Jr.; Sarah Taylor; Warren Comstock

(57) ABSTRACT

A method of manufacturing a diaphragm backing plate for use in a brake booster comprising the steps of moving a coil of metal having parallel first and second sides that define a first width to a first station. Applying a stamping force to remove a section from the coil of metal and create a first plate defined by equal and parallel sides that are connected to each other by an arcuate segments each having a radius that is approximately equal to one-half of the width of the coil plus a minimum width of a lip. Moving the plate to a second station and thereafter rolling a peripheral surface thereon to define a uniform diameter for the plate that is approximately equal to the first width of the roll less twice the minimum width for the lip.

3 Claims, 4 Drawing Sheets

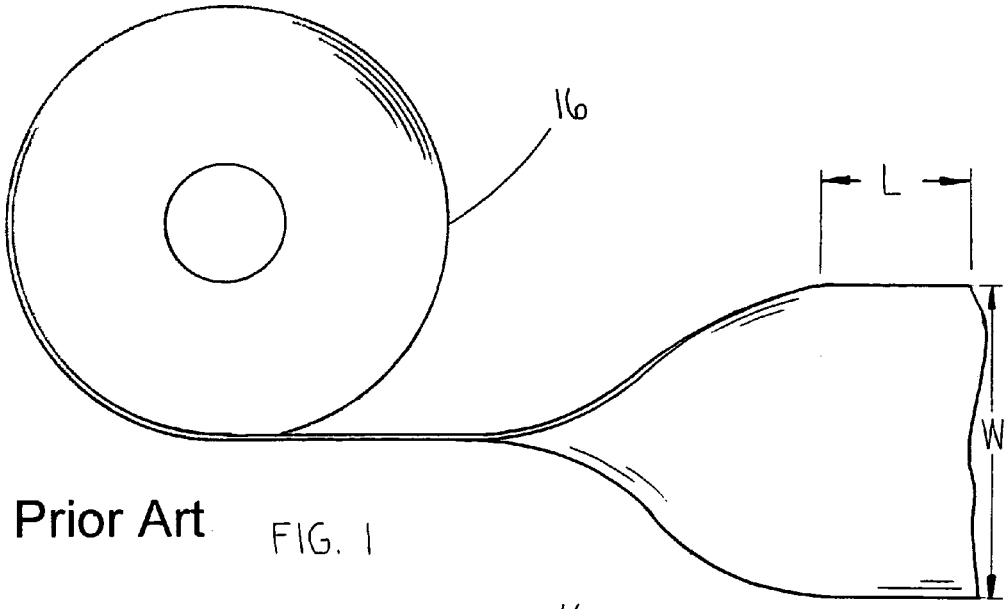
Prior Art FIG. 1
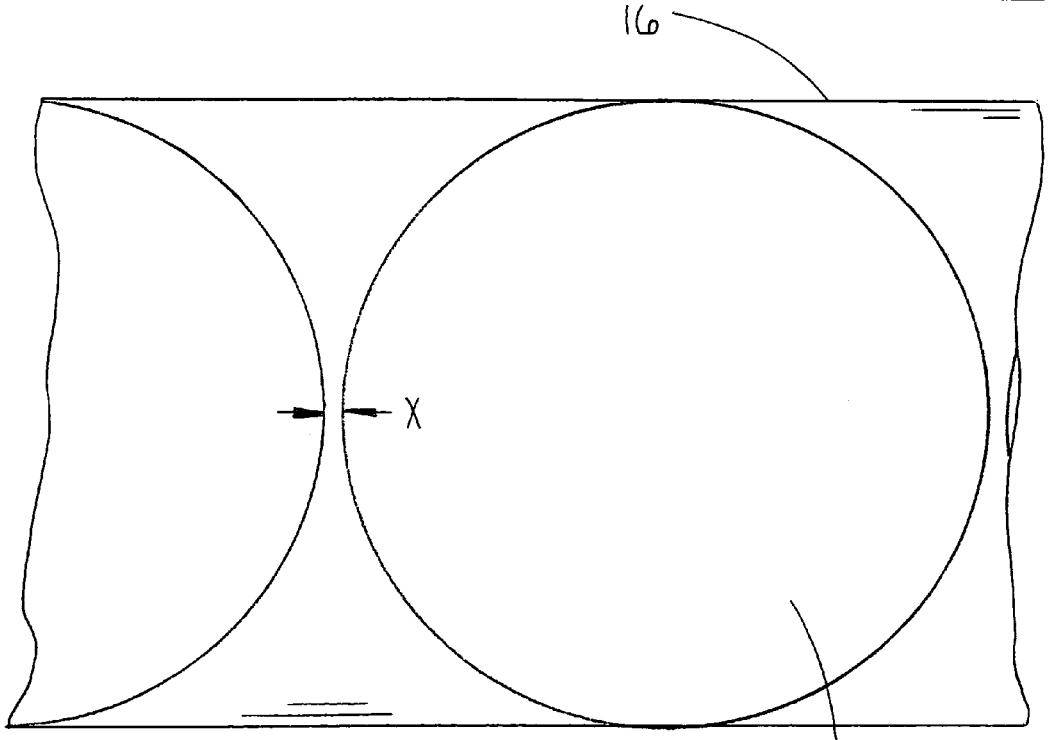
FIG. 2 Prior Art

METHOD OF MANUFACTURING A DIAPHRAGM BACKING PLATE

BACKGROUND OF INVENTION

This invention relates to a method of manufacturing a diaphragm backing plate for use in a brake booster.

The manufacture of a backing plate is usually achieved through a progressive stamping procedure that includes moving a coil of metal to a first station where a rough blanked disc having a first diameter in stamped or punched out of the coil. The rough blanked disc is then moved to a second station where the first diameter is then reduced by a secondary trim operation to a desired second diameter that is approximately equal to a desired diameter for a backing plate plus a width for a lip that will be rolled on the peripheral edge. The trimmed disc is then transferred to a third station where the lip is rolled around the peripheral edge to define a desire diameter for the backing plate. This process while functioning in a satisfactory manner includes waste as material is lost as scrap because of a need for the secondary trim operation blanking step. While the amount of material loss for an individual plate may not be excessive, the cumulative loss for a coil of metal may amount to up to one percent of the roll of metal.

SUMMARY OF INVENTION

A primary object of the present invention is to increase the amount of material in a coil of metal that is utilized in the production of a diaphragm backing plate for a brake booster.

According to this invention, a diaphragm backing plate is manufactured that substantially utilizes an entire roll of metal and includes the following steps:

moving a coil of metal material having first and second sides that define a first width to a first station;

applying a force to remove a section from the coil of metal material and create a first plate that is defined by equal and parallel sides that are connected to each other by an arcuate segments each of which have a radius that is approximately equal to one-half of the width of the coil of metal material plus a minimum width of a lip; and moving the plate to a second station and utilizing the parallel sides to align the plate in a die and then rolling the peripheral surface thereon to define a uniform diameter for the plate that is approximately equal to the first width of the coil of metal material less the minimum width for the lip.

An advantage of this invention resides in the use of the width of a coil of metal material as a final dimension in defining a diameter for a diaphragm backing plate.

A further advantage of this invention resides in a reduction in the sequential spacing between blanks obtained from a coil of metal material through the orientation of acruate segments at approximately a right angle to X—X and Y—Y coordinates corresponding to parallel sides of a blank.

BRIEF DESCRIPTION OF DRAWINGS

FIG. 1 is a schematic illustration a coil of metal material for use in the manufacture of a diaphragm backing plate;

FIG. 2 is an illustration of an outline of a first blank to be obtained from the coil of metal material a first station for use in the manufacture of a diaphragm backing plate in a manner known in the prior art;

DETAILED DESCRIPTION

Figure 4:
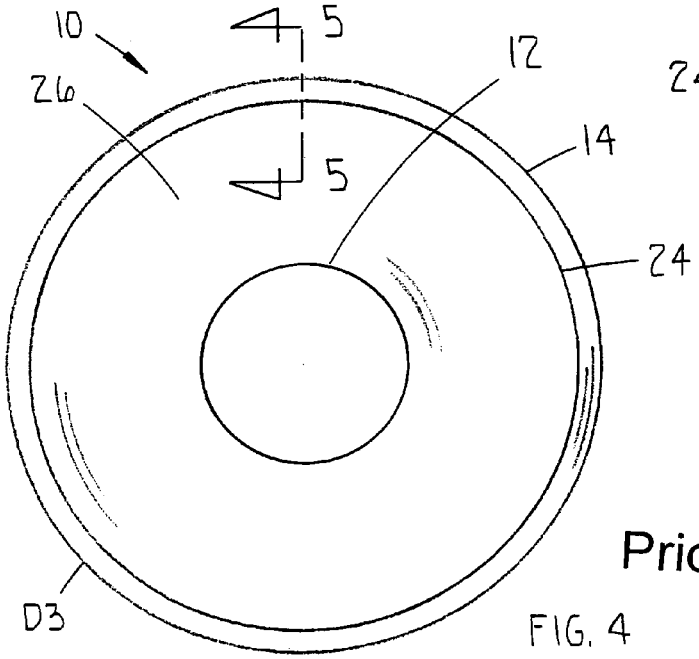
Prior Art FIG. 4
FIG. 4 is a schematic illustration of the blank of FIG. 3 wherein a lip is rolled on a peripheral surface to define a desired diameter for the diaphragm backing plate.
Figure 5:
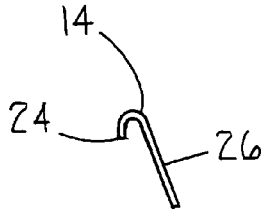
FIG. 5 Prior Art
FIG. 5 is a sectional view taken along lines 5—5 of FIG. 4 showing the lip.

A backing plate 10, of a type illustrated in FIGS. 4 and 5, provides strength through which a force created by a pressure differential on opposite sides of a diaphragm in the brake booster may be transmitted into a hub for moving an output member to effect a brake application. The backing plate 10 has an inner diameter 12 that is common for various size brake booster, however, an outer diameter 14 may vary to achieve different levels of output force needed to effecting brake applications for vehicles.

Figure 3:
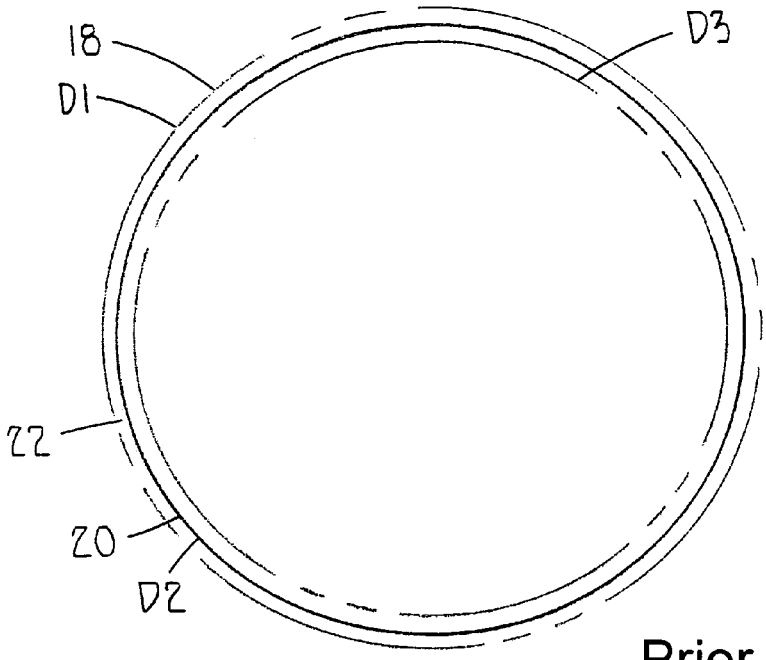
Prior Art FIG. 3
FIG. 3 is an illustration of a second blank obtained by timiming the first blank at a second station in the manufacture of a diaphragm backing plate.

The backing plate 10 as illustrated in FIGS. 4 and 5 is manufactured from a coil of metal material 16 illustrated in FIG. 1. The coil of metal material 16 is obtained from a supplier and has a defined width "W" from which a length "L" is cut for a blank for each backing plate 10. The length L plus a length "X" is such that a certain number of backing plates may be obtained from a coil of material 16 that is un-rolled and fed into a stamping press at a first station as illustrated in FIG. 2. A force is applied to a rough die and a blank 18 is produced through a rough blanking step from the coil of metal material 16, the blank 18 has a substantially rough diameter equal to D-1. The blank 18 is transported to a stamping press at a second station and a second force is applied to trim the blank 18 and create a blank 20 that has a diameter equal to D-2, as illustrated in FIG. 3. The amount of material trimmed from blank 18 to produce blank 20 is uniform and is represented by a ring 22. The amount of material in ring 22 is waste and occurs in the manufacture of each backing plate 10. The blank 20 is transmitted to a third station and a lip 24 is rolled on the peripheral to produce a blank 26 having a diameter equal to D-3 on its outer surface 14, as illustrated in FIGS. 4 and 5. The blank 26 is next transported to a fourth station where the surface between the inner 12 and outer surfaces are stamped therein to produce various ridges to complete the manufacture of the backing plate 10. This process while satisfactory does result in a waste of metal material since a scrap ring 22 is produced with the manufacture of each backing plate 10.

Figure 6:
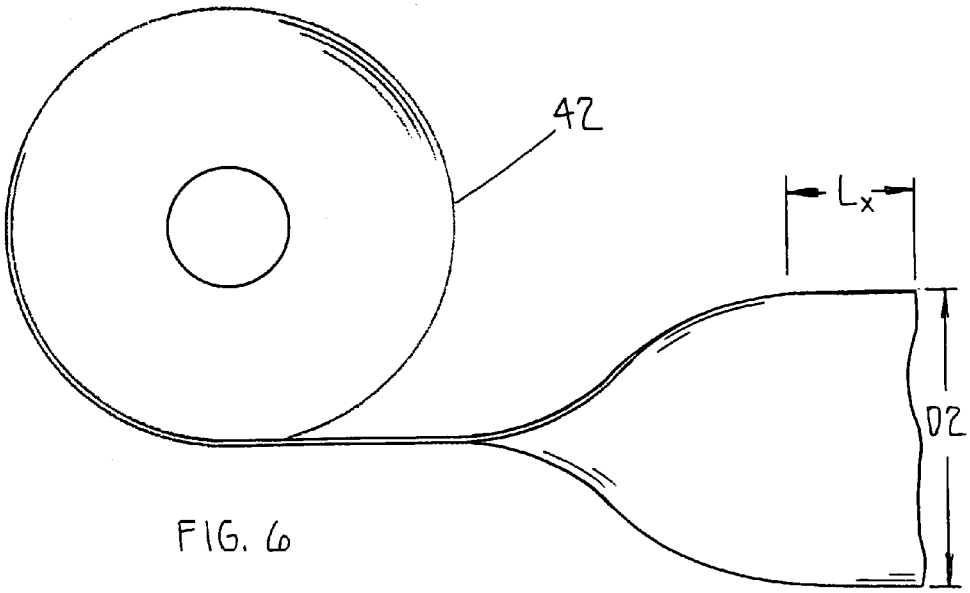
FIG. 6 is a schematic illustration of a coil of metal material for use in the manufacture of a diaphragm backing plate according to the present invention.
Figure 7:
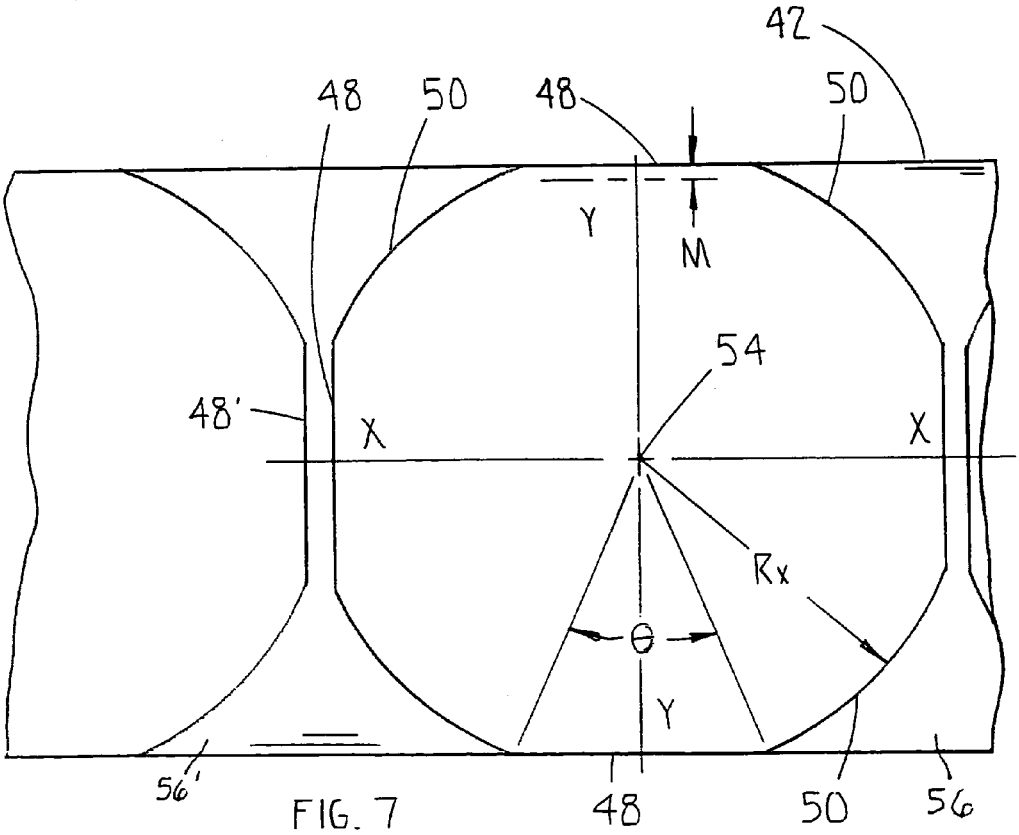
FIG. 7 is a an illustration of an outline of a blank to be obtained from the coil of metal material of FIG. 6 at a first station for use in the manufacture of a diaphragm backing plate according to the present invention.
Figure 8:
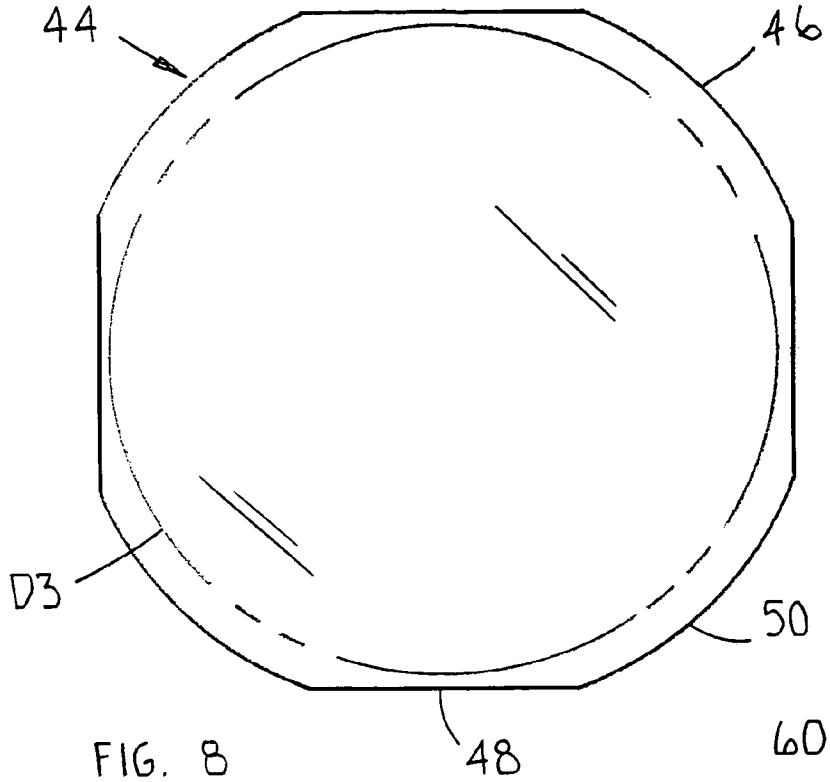
FIG. 8 an illustration of the blank obtained from the coil of metal material a first station for use in the manufacture of a diaphragm backing plate.
Figure 10:
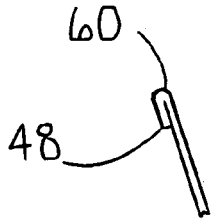
FIG. 10 is a sectional view taken along lines 10—10 of FIG. 9.
Figure 9:
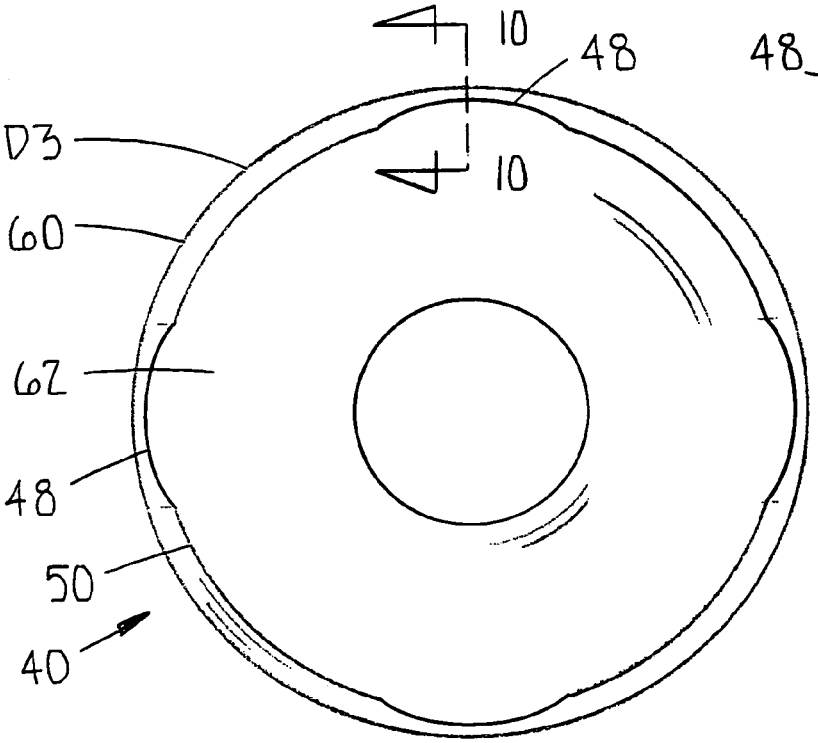
FIG. 9 is a schematic illustration of the blank disc of FIG. 8 wherein a lip is rolled on a peripheral surface to define a desired diameter for a diaphragm backing plate.

According to the present invention it has been determined that a diaphragm backing plate 40, as illustrated in FIGS. 9 and 10, may be manufactured from a coil of metal 42 having a width is equal to diameter D-2, as shown in FIGS. 6 and 7. In this method, the coil of metal material 42 is fed into a stamping press at first station however the length that is fed into the stamping press at a first station is now Lx as the overall dimension needed to manufacture the diaphragm backing plate 40 is reduced by an amount equal to Rx-½ D-2. A force is applied at this station to produce a plate or blank 44, see FIG. 8. Blank 44 is characterized by a plate having a peripheral surface 46 with equal and parallel sides 48 that are connected to each other by an arcuate segment 50. Each arcuate segment has a radius Rx that is approximately equal to one-half of the diameter D-2 plus a minimum width "m" of a desired lip for a diaphragm backing plate 40 while the parallel sides are located at an equal distance from a y coordinate of the center of the coil of metal material 42 and defined by a length along an x coordinate at a point where the radius Rx intersects the y-coordinate on either side of an axial center defined by a pilot hole 54 by the removal of a segment 56 of material from the coil of metal material 42. When the segment 56 of metal material is removed from the coil of material 42, a pilot hole 54 may be punched in each blank 44 such that parallel side 48' on the next blank 44' is complimentary to parallel side 48. After a blank 44 is stamped it is transferred to a second station and the parallel sides 48 engage a die and along with the pilot hole 54 align the blank 44 such that a lip 60 having a minimum width m is rolled on the outer or peripheral surface to produce a blank 62 having a diameter D-3, as illustrated in FIGS. 9 and 10 wherein the lip has a scalloped surface. Thereafter, the blank 62 is transferred to a fourth station and the surface between the inner surface 12 and outer surface 14 stamped to produce various ridges therein to complete the manufacture of the diaphragm backing plate 40.

The material savings for each diaphragm backing plate is defined by a difference between an area bounded by a arcuate segment RxΘ less the area of isosceles triangle sin ΘRx times the thickness of the coil of metal material 42 times 4. The savings of metal material is a direct result achieved by method of manufacturing a diaphragm backing plate 40 by the invention. In addition, because of the positioning of a die with respect to the coil of metal 16 wherein the acruate segments at approximately a right angle to X—X and Y—Y coordinates corresponding to parallel sides of a blank 44, additional blanks 44' may be stamped out of a coil of metal material 42 to add to the savings in the manufacture of the diaphragm backing plate 40.

I claim:

1. A method of manufacturing a diaphragm backing plate for use in a brake booster comprising the steps of:

moving a coil of metal to a first station, said coil having a first and second sides to define a first width;

applying a force to remove a section from the roll of metal to create a first plate defined by a peripheral surface having equal and parallel sides connected to each other by an arcuate segment each of which has a radius that is approximately equal to one-half of the width of the coil plus a minimum width of a desired peripheral lip for the diaphragm backing plate and wherein each parallel side is located at an equal distance from the center of the first plate along a X coordinate in a Y coordinate that is defined by a point where the radius intersects the Y coordinate;

punching a pilot hole in the center of the first plate;

moving the first plate to a second station where the parallel sides and pilot hole retain the alignment therein; and thereafter rolling the peripheral surface on said first plate to define a uniform diameter for a resulting second plate with the desired peripheral lip having a uniform circumference, said uniform diameter for the second plate being approximately equal to the width of said coil less twice minimum width for said lip while said lip has a scalloped surface with radially inwardly directed circular segments.

2. The method as recited in claim 1 further including the step of:

punching a second pilot hole along the axial center of said coil at distance that is equal to said radius to define an axial center for a next plate.

3. The method as recited in claim 2 wherein said step of removing a section of said coil includes the forming of complimentary sides for said first plate and next plates.

* * * * *